US007762163B1

(12) United States Patent
Broadus

(10) Patent No.: US 7,762,163 B1
(45) Date of Patent: Jul. 27, 2010

(54) COMBINATION PLIERS AND SPUDDING TOOL

(76) Inventor: Brad Broadus, P.O. Box 40, Calico Rock, AR (US) 72519

( * ) Notice: Subject to any disclaimer, the term of this patent is extended or adjusted under 35 U.S.C. 154(b) by 0 days.

(21) Appl. No.: 12/081,810

(22) Filed: Apr. 22, 2008

Related U.S. Application Data

(63) Continuation-in-part of application No. 11/808,716, filed on Jun. 12, 2007, now Pat. No. 7,530,296.

(51) Int. Cl.
*B25B 7/04* (2006.01)

(52) U.S. Cl. ..... 81/414; 81/489

(58) Field of Classification Search ..... 81/414, 81/489

See application file for complete search history.

(56) References Cited

U.S. PATENT DOCUMENTS

| | | | | |
|---|---|---|---|---|
| 753,048 | A | | 2/1904 | Des Moineaux |
| 854,248 | A | | 5/1907 | Smith |
| 1,615,450 | A | | 9/1919 | Zim |
| 1,341,712 | A | | 6/1920 | Gell |
| 1,342,856 | A | | 6/1920 | McDowell |
| 1,490,903 | A | | 4/1924 | Anderson |
| 1,498,844 | A | | 6/1924 | Laflin |
| 1,828,142 | A | | 10/1931 | Herdman |
| 2,366,312 | A | | 1/1945 | Brintnall |
| 2,600,445 | A | | 6/1952 | Sundstand |
| 3,333,492 | A | | 8/1967 | Chapman |
| 3,760,473 | A | * | 9/1973 | Studdard ..... 407/29.1 |
| 4,375,174 | A | | 3/1983 | Shanley, Jr. |
| 4,539,873 | A | | 9/1985 | Freed |
| 4,794,824 | A | | 1/1989 | Chapman |
| 5,267,366 | A | * | 12/1993 | Frazer ..... 7/128 |
| 5,575,029 | A | | 11/1996 | Simpson |
| 5,809,853 | A | | 9/1998 | Hudson |
| 6,081,952 | A | | 7/2000 | Haxton |
| 6,901,823 | B2 | | 6/2005 | Ernesti |
| 2005/0177954 | A1 | * | 8/2005 | Smith ..... 7/128 |

* cited by examiner

*Primary Examiner*—Joseph J Hail, III
*Assistant Examiner*—Shantese McDonald
(74) *Attorney, Agent, or Firm*—Dowell & Dowell P.C.

(57) ABSTRACT

A combination tool that includes opposing jaws and handles that function as conventional pliers and wherein the handles are configured to be abutted with one another to form a spudding tool having a generally circular cross section and wherein at least one ridge extending from one of the handles cooperatively seats within at least one groove in the opposing handle when the handles are abutted with one another.

7 Claims, 3 Drawing Sheets

COMBINATION PLIERS AND SPUDDING TOOL

CROSS REFERENCE TO RELATED APPLICATIONS

This application is a Continuation-in-Part of U.S. patent application Ser. No. 11/808,716, filed Jun. 12, 2007, in the name of the same inventor and the entire contents of which are incorporated herein by reference.

BACKGROUND OF THE INVENTION

1. Field of the Invention

This application is directed to a combination hand tool that may be used as conventional pliers, and preferably, channel lock pliers, as well as for a spudding tool that may be used to engage and align parts, components and other structural elements by hand wherein one or more openings in the structural elements to be aligned are used to manipulated the structural elements with respect to one another.

2. Brief Description of the Related Art

Spudding tools are hand held or manipulated tools that include a pointed shaft that is tapered from a pointed end outwardly to a handle. Such tools are used to facilitate the alignment of parts, plates or other members that are to be aligned for one reason or another, such that they be ultimately connected or joined. Such tools are commonly used by iron workers, millwrights, metal building fabricators and erectors, machinists, shop mechanics, concrete form assemblers and the like.

Conventional spudding tools are formed as a single "shaft-like" device that is integrally formed of a metal material. The tools have very limited functionality and are specifically designed and configured for use as alignment probes for specific members, objects or structures or to clear holes that must be cleaned or finished in order to permit bolts or other fasteners to be inserted and properly seated therein during a "bolt-up" assembly of parts or components.

Unfortunately, because of their limited functionality for the alignment of two or more separate objects or the finishing or clearing of holes, such tools have been exclusively required as separate members of a workers tool set. Further, because the size of the members, objects or structures to be aligned or finished may vary, workers must often carry a plurality of spudding tools.

Often, those who must use spudding tools must also have tools that are useful to grip and manipulate objects in a manner that is possible using pliers or the like. Therefore, such workers must carry a plurality of separate tools to perform separate hand manipulative functions. Not only does the need for a plurality of separate tools require a greater economic expenditure to be made for the tools used in a specific trade, but the need to carry additional tools for separate unique functions adds to the logistical burdens that are placed on workers to carry the tools on work projects.

In view of the foregoing, there is a need to provide a tool that is unique and multi-functional and not only provides usefulness as a hand held pair of pliers, or the like, but wherein the pliers may also be used in a safe manner as a spudding tool to facilitate the alignment of parts and components as may be necessary on a specific work site or to clear or finished rough openings or holes in work members.

SUMMARY OF THE INVENTION

This application is directed to a combination hand tool that includes a pair of opposing jaws that may be manipulated in the manner of conventional pliers, or the like, and more particularly, to a tool having a pair of hand manipulated handles that are used to control movement and force generated by the opposing jaws of the tool and, wherein, the tool may be used as a spudding tool by interengaging the handles of the tool with one another, when the handles are closed relative to one another, to thereby create a reinforced and pointed rod-like spudding tool.

More specifically, with the present invention, a first handle is configured with an inner concave surface that extends along at least a portion of the length of the handle and a second opposite handle is configured such that an inner surface thereof is of a size and shape to be cooperatively seated within the concave surface of the first handle such that the two handles, when closed relative to one another, form a spudding tool that tappers inwardly to a pointed end and which is generally circular in cross section at any plane taken perpendicularly to an elongated central axis of the closed handles. The outer surfaces of the handles are rounded and concave.

It is a primary object of the invention to provide a combination tool that may be used as a conventional pair of pliers, such as a pair of channel-lock pliers and wherein, when the handles of the pliers are closed relative to one another, the handles interlock with one another such that the opposing handles form a rod shaped structure that tapers inwardly toward an outer end thereof such that the handles may be used as a spudding tool.

It is another object of the invention to both reduce tool costs and to enhance the usefulness of a single tool to provide for a plurality of differing work functions.

BRIEF DESCRIPTION OF THE DRAWINGS

A better understanding of the present invention will be had with reference to the accompanying drawings wherein.

DESCRIPTION OF THE PREFERRED EMBODIMENT

Figure 1:
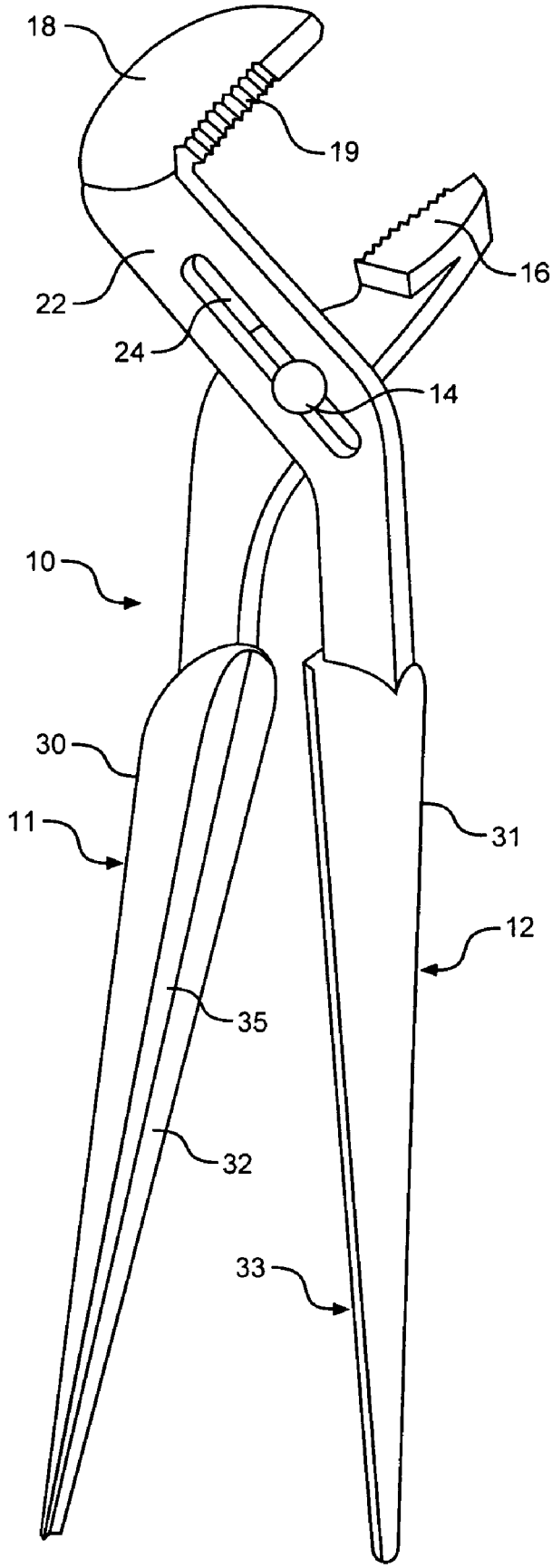
FIG. 1 is a front view of a pair of channel lock pliers that includes opposing handles that are configured to be cooperatively seated relative to one another to form a tapered pointed spudding tool when they are closed together.
Figure 2:
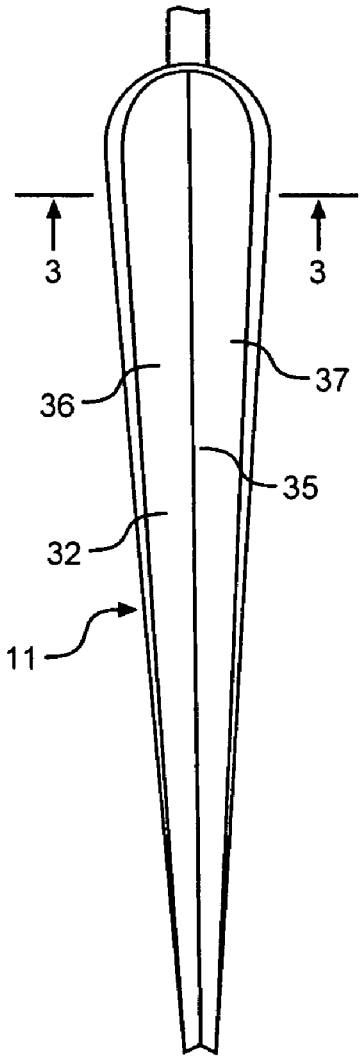
FIG. 2 is a front elevational view of a first handle of the channel lock pliers of FIG. 1 showing a concave inner surface configuration of the handle.
Figure 3:
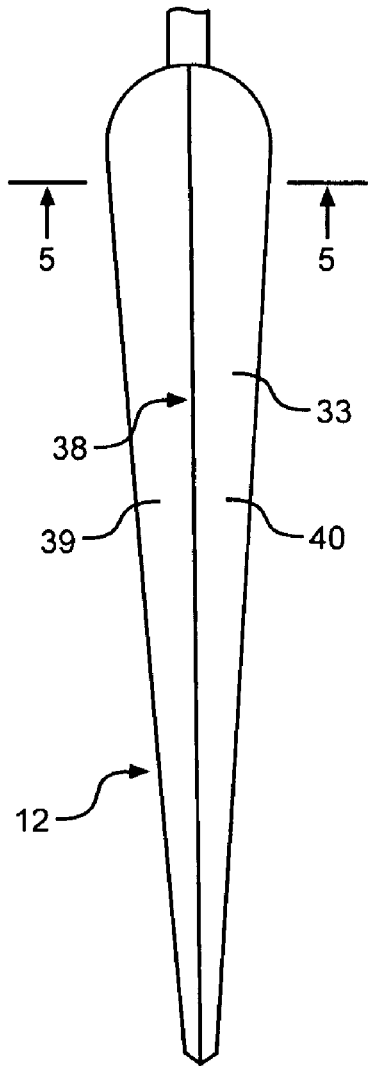
FIG. 3 is a cross sectional view taken through line 3-3 of FIG. 2.
Figure 4:
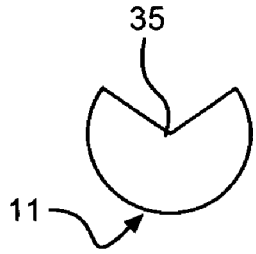
FIG. 4 is a front perspective view of a second handle of the tool of the present invention showing a convex inner surface of the second handle that is configured to cooperatively seat within the concave surface of the first handle when the handles are closed relative to one another.
Figure 5:
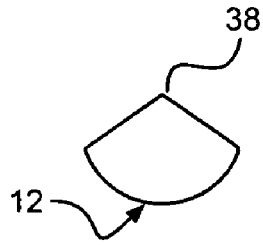
FIG. 5 is a cross sectional view taken along line 5-5 of FIG. 4.

With continued reference to the drawings, the combination hand tool of the invention includes a pair of pliers 10, which are shown as channel lock pliers having a pair of handles 11 and 12 that are connected to one another by a pivot pin 14. The handles are integrally formed with opposing jaw members 16 and 18 that are preferably provided with teeth 19 to facilitate gripping an object to be manipulated by the pliers. As the preferred embodiment shown in the drawings is directed to a pair of channel lock type pliers, the jaws and handles are connected by the pivot pin so as to be selectively adjustable relative to one another such that the spacing between the jaws may be varied as required. In this respect, jaw member 18 is connected to handle 12 by way of an integral connector segment 22 that includes an elongated slot 24 in which the pivot pin 14 is guidingly retained such that an actual pivot point between the jaws may be varied as desired.

Figure 6:
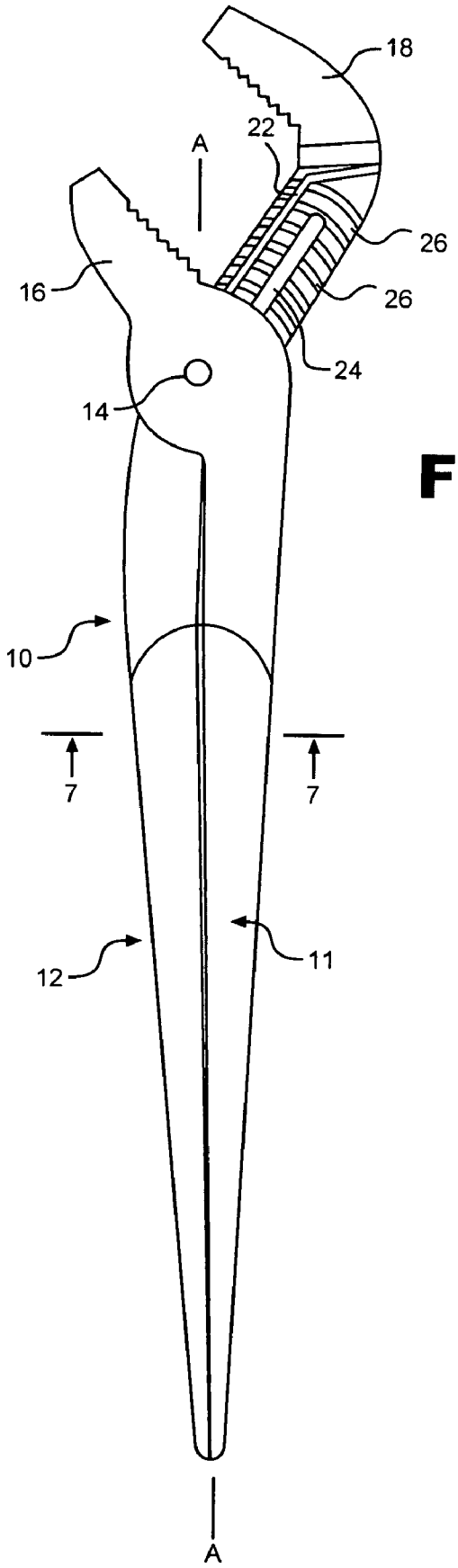
FIG. 6 shows the pliers of FIG. 1 with the handles closed relative to one another in order to form a spudding tool with a body that tappers to a remote tip.

In order to constrain the arcuate movement of the jaws in a fixed arcuate motion relative to one another regardless of the position of the pivot pin with respect to the slot 24, a series of generally equally spaced and arcuate ridges 25 and grooves 26 are formed in the connector segment that mesh with complementary arcuate ridges and grooves, not shown, that are formed in a connector segment 28 of the opposite handle 11. The meshed engagement of the opposing ridges and grooves ensures an arcuate motion of the opposing jaws relative to one another regardless of the spacing there between. Thus the jaws may be adjusted in increments between a maximum spacing, as shown in FIG. 6 to closed relationship not shown in the drawing figures.

Figure 7:
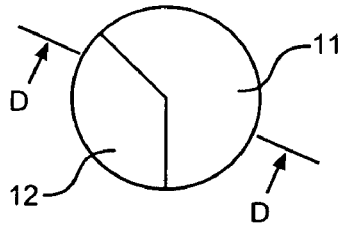
FIG. 7 is a cross sectional view taken along line 7-7 of FIG. 6.

As previously described, conventional spudding tools are rod-like tools that taper inwardly from a handle portion to a narrow tip that is used to adjust the position of one part or element with respect to another or to clear holes that must be cleaned or finished in order to permit bolts or other fasteners to be inserted therein during a "bolt-up" assembly of parts or components. Because of their area of use, spudding tools are generally circular in cross section with the diameter of the tools progressively narrowing from the handles to the tips of the tools. As shown in the drawing figures of the present invention, each of the handles 11 and 12 are formed having semicircular and convex outer surfaces 30 and 31. The inner surfaces 32 and 33 of the handles 11 and 12 are also cooperatively configured such that when the handles are aligned and closed relative to one another, as shown in FIG. 6, the combined cross sections of the two handles taken perpendicularly relative to an elongated axis "A" of the handles when closed relative to one another, as shown in FIG. 6, is circular having a diameter "D", as shown in FIG. 7, that varies along the length of the tool, just the same as a conventional spudding tool.

To reinforce the handles when they are closed relative to one another to form a spudding tool, the inner surface 32 of handle 11 has a groove 35 extending along at least a portion of the length thereof such that a least a portion of the length of the handle is concave have angled walls 36 and 37 that define the groove 35. In the drawings the groove extends along a full length of the handle 11, however, it is possible that the groove only extends along a portion of the length of the handle and still provide for the reinforcing of the handles when closed relative to one another, as is discussed herein. In some embodiments, more than one groove 35 may be provided in handle 11. In the preferred embodiment shown, the groove is generally v-shaped. The inner surface 33 of the handle 12 is shown as defining an outstanding or projecting ridge 38 defined by angled planar walls 39 and 40. The size and configuration of the ridge 38 is such that when the handles are closed relative to one another, the ridge cooperatively seats or fits within the groove with very little clearance such that the interfitting relationship of the ridge and the groove reinforces the closed handles and prevents any accidental shifting of the handles relative to one another when the combination tool is being used as a spudding tool. In those embodiments wherein more that one groove is provided in the handle 11, a like number of ridges will be provided along the inner surface of the second handle 12 to cooperatively seat within the grooves.

As a further embodiment of the invention, it is possible that handle 11 could have one or more spaced grooves and ridges that would cooperate seat with one or more spaced grooves and ridges formed in handle 12.

As shown in the drawing figures, in the preferred embodiment, only when the jaws of the combination tool are opened to their widest extent such that the pivot pin 14 rests against an end wall of the slot 24, are the handles properly aligned with one another to form the spudding tool. It is possible that the tool could be constructed such that the handles will only seat with one another when the jaws are closed relative to one another.

In view of the foregoing, the combination tool of the present invention provides usefulness as a conventional pair of pliers, and particularly, channel-lock pliers, and also provides usefulness as a spudding tool when the handles are brought together with the ridge or ridges of one handle seated within the mating groove or grooves in the other. As previously noted, in some embodiments ridges may be provided on both handles that may be selectively seated within grooves provided in the opposite handle.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

I claim:

1. A combination tool comprising a pair of pliers having a pair of opposing jaws that extend from opposing first and second handles, said opposing first and second handles tapers inwardly from adjacent said pivot means to free tip end portions thereof; pivot means pivotally connecting the opposing first and second handles to one another, each of said first and second handles having opposing inner surfaces and oppositely oriented outer surfaces, at least a portion of said inner surface of at least said first handle being generally concave so as to define a groove, at least a portion of said inner surface of at least said second handle being generally convex and defining a ridge of a size to cooperatively seat within said groove when said first and second handles are closed into engagement with one another to thereby create a spudding tool wherein said ridge and said groove are cooperatively sized to reinforce and prevent accidental shifting of the opposing handles when said ridge is seated within said groove to thereby create the spudding tool.

2. The combination tool of claim 1 wherein said outer surfaces of each of said opposing first and second handles is generally semicircular perpendicularly with respect to an elongated axis thereof when the inner surfaces thereof are abutted one against the other so that a combined cross section of the handles is generally circular.

3. The combination tool of claim 2 wherein said pivot means is adjustable along a slot formed in a section intermediate one of said first and second handles and associated jaws of the tool such that the spacing between opposing jaws may be varied from a close proximity relative to one another to a fully spaced relationship relative to one another.

4. The combination tool of claim 3 wherein said ridge only aligns to seat within said groove when said pivot means is positioned relative to said slot to fully space said jaws relative to one another.

5. The combination tool of claim 2 wherein said groove extends along substantially a full length of said first handle and said ridge extends along substantially a full length of said second handle.

6. The combination tool of claim 5 wherein said groove is generally v-shaped being defined by two angled and planar walls.

7. The combination tool of claim 2 wherein said groove is generally v-shaped being defined by two angled and planar walls.

* * * * *